United States Patent [19]

Fox et al.

[11] Patent Number: 4,604,546

[45] Date of Patent: Aug. 5, 1986

[54] INCANDESCENT LAMP MOUNT STRUCTURE WITH SHIELD FOR EVAPORATION PRODUCTS

[75] Inventors: David H. Fox, Beverly, Mass.; Lonnie Robinson, Baskin Ridge, N.J.

[73] Assignee: GTE Products Corporation, Danvers, Mass.

[21] Appl. No.: 627,397

[22] Filed: Jul. 3, 1984

[51] Int. Cl.[4] ..... H01J 1/88

[52] U.S. Cl. ..... 313/272; 313/348; 313/350

[58] Field of Search ..... 313/272–348, 313/350

[56] References Cited

U.S. PATENT DOCUMENTS

| | | | |
|---|---|---|---|
| 1,348,350 | 8/1920 | Davis | 313/272 |
| 2,046,906 | 7/1936 | O'Meara | 313/272 |
| 2,688,711 | 9/1954 | Camillerapp | 313/272 |
| 2,877,375 | 3/1959 | Pearson | 313/315 |
| 3,156,843 | 11/1964 | Swasey et al. | 313/271 |
| 3,296,400 | 1/1967 | Kienzle | 200/130 |
| 3,486,063 | 12/1969 | Ruben | 313/222 |
| 3,789,255 | 1/1974 | Sell et al. | 313/217 |
| 4,093,894 | 6/1978 | Leighton | 315/64 |
| 4,131,819 | 12/1978 | Graves | 313/331 |
| 4,138,623 | 2/1979 | McMillan | 313/331 |
| 4,233,536 | 11/1980 | Waymouth et al. | 313/174 |
| 4,395,653 | 7/1983 | Graff | 313/112 |
| 4,400,646 | 8/1983 | Lohrey | 313/333 |

*Primary Examiner*—Harold Dixon

*Attorney, Agent, or Firm*—Hamilton, Brook, Smith & Reynolds

[57] ABSTRACT

A "3-lite" incandescent lamp structure is disclosed which is capable of being mounted in either a "base down" orientation or a "base up" orientation without damage to the internal glass button support assembly. A shield is provided adjacent to the glass button support assembly to minimize damage to the support assembly from the gaseous deposition products generated by the lamp filaments.

18 Claims, 4 Drawing Figures

INCANDESCENT LAMP MOUNT STRUCTURE WITH SHIELD FOR EVAPORATION PRODUCTS

TECHNICAL FIELD

This invention relates to the manufacture of incandescent lamps and, more particularly, to the fabrication of "3-lite" lamps and the like.

BACKGROUND ART

Prior art "3-lite" lamps of the type, for example, shown in FIG. 16, of Swasey et al. U.S. Pat. No. 3,156,843 are provided with two filaments which are mechanically and electrically connected to a special three "Kon-Tact" base in such a manner that, in combination with suitable switching means, light of three different intensities and corresponding wattages can be selected. For example, a 50-200-250 watt lamp of this type is one which is provided with a 50-watt filament and a 200-watt filament.

These lamps are generally operated in a "base down" burning position, for example, in a table or floor stand fixture to provide a low light level (50-watt), a medium level (200-watt) or a high light level (250-watt) for reading. "Base down" means that in operation, the lamp bulb and filament are located above the bulb base and socket.

Such lamps have evolved into shorter overall length lamps than comparable standard lamps of similar wattage. For instance, the now standard 200-watt A23 lamp has a maximum overall length, as recommended by the American National Standards Institute specification number ANSI C78.100-1976 of 6-5/16" while a comparable 5/2/250/A23 "3-lite" lamp has a maximum overall length of 5-5/16". The resulting difference of 1" is also reflected in the filament location within the lamp, commonly referred to as LCL or "light center length". LCL is the distance from the center of light source to the base center contact. In order to center the filament at the maximum bulb diameter, the LCL of the 200-watt A23 lamp is $4\frac{5}{8}$" and that of the three-light lamp is $3\frac{5}{8}$".

The resultant compactness of the lamp structure in "3-lite" lamps of this type has created problems when such lamps are desired for use in a "base up" orientation. One problem involves the glass arbor button to which the filament support wires for such lamps are affixed. The glass arbor button is located below and adjacent to the filaments. In the "base down" orientation of the lamp, the hot gases emanating from the filaments deposits gaseous material on the lamp envelope and does not damage the glass button support. However, in the "base up" orientation such gaseous material deposits on the glass arbor button support assembly increasing heat absorption and eventually causing the button to melt. Even when melting does not occur, copious amounts of $H_2O$ are evolved from the glass, thus shortening lamp life. The resultant short life when burning lamps in the "base up" orientation has restricted the design and development of new fixtures and has thus significantly limited the applications and market for such lamps.

DISCLOSURE OF THE INVENTION

In accordance with the invention an aluminum or nickel wire and/or ribbon is spot-welded to a filament lead wire and suspended over the glass arbor button or doughnut to provide a shield between the lamp filaments and the glass arbor button. Without the buildup of tungsten on the glass button, heat absorption is greatly reduced, preventing the glass from melting and also preventing evolution of $H_2O$ from the glass, which otherwise shortens the life of the lamp, especially when used in an enclosed fixture which heats the bulb hotter than its normal temperature range when exposed directly to the ambient atmosphere.

BEST MODE OF CARRYING OUT THE INVENTION

A preferred embodiment of this invention will now be described in more detail with reference to the figures.

Figure 1:
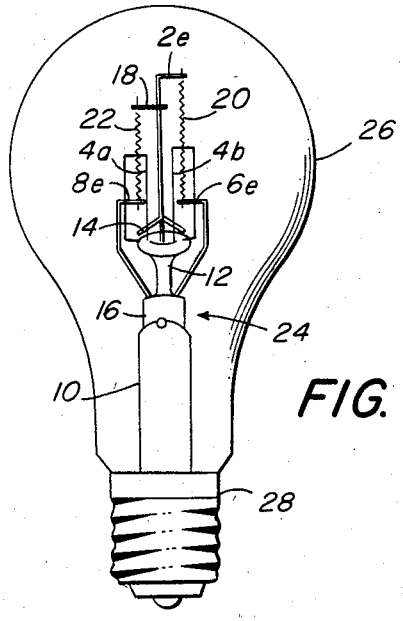
FIG. 1 is an elevation view of a dual filament incandescent lamp structure of the invention.

FIG. 1 shows the overall structure of the invention; in which an hermetically sealed lamp envelope 26 is provided with a base 28 secured to the envelope. Lead-in wires **2*e*, 8*e*, and 6*e* extend through and are hermetically sealed within stem 10 and stem press 16 and make appropriate connection to three contacts (not shown) within the base 28**.

Figure 2:
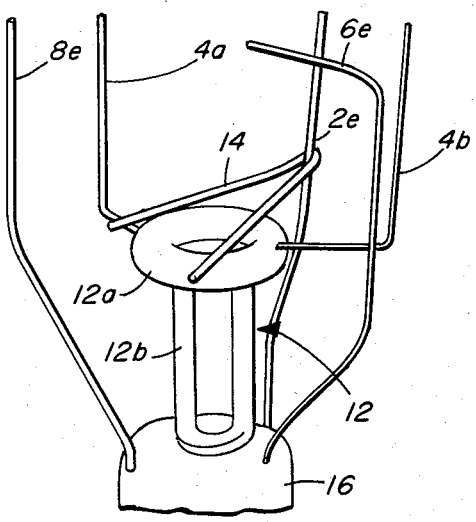
FIG. 2 is an elevation view on an enlarged scale of a fragment of the apparatus of FIG. 1.

A glass arbor 12 which is supported from stem press 16, as may be seen more clearly in FIG. 2, is formed from a cylindrical glass tube. The tubular portion is shown at **12*b*. One end of the tubular portion is heated and flattened with a mandrel to form a doughnut-shape or button pedestal structure 12*a*. Filament support wires 4*a* and 4*b* extend from each side of the doughnut-shape portion 12*a* of the arbor 12 to the midsection of resistive tungsten filaments 20 and 22. Tungsten filament 20 is supported at one end by lead-in wire 6*e* and is in electrical contact with lead-in wire 6*e* at that end. The remaining end of filament 20 is in electrical contact with lead-in wire 2*e***.

Filament 22 is supported at one end by lead-in wire **8*e* and is in electrical contact at that end with lead-in wire 8*e*. The remaining end of filament 22 is supported by wire 18 and is in conductive electrical contact with lead-in wire 2*e* through wire 18**.

It should be noted that up to this point, the incandescent lamp of FIG. 1 is substantially identical to the prior art lamp, as typified by that described in FIG. 16 of the Swasey et al. U.S. Pat. No. 3,156,843, except for the arbor 12 from which filament support wires **4*b* and 4*a*** extend.

In accordance with the present invention, it is desired to provide a means for shielding the glass button **12*a* at the top of arbor 12 from the hot gases which emanate from the filaments 20 and 22 when heated. Normally, these gases are not a problem in the "base down" operating position of the lamp, since such gases will rise carrying filament evaporation materials and deposit them on the nearest surface, i.e, the interior surface of bulb 26. However, in the "base up" position, such gases will rise and deposit on the doughnut-shape portion 12*a* of arbor 12, thereby greatly increasing the heat absorption on this surface and ultimately resulting in evolution of $H_2O$ and even melting of the button 12***a* with failure of the lamp.

Accordingly, there is provided in accordance with the invention, a V-shaped shield 14, as more clearly shown on FIG. 2, which may comprise a small wire or ribbon of sufficient purity and composition for incandescent lamps. This small wire or ribbon is preferably about 0.026 inches wide by 0.013 inches thick and approximately ½ inches long per leg and may be mounted (spot-welded) automatically to one of the filament lead-in wires, such as lead-in support wire 2*e*. Shield 14 thereby extends over the doughnut-shape button 12*a* causing the normal tungsten filament evaporation particles to deposit on the shield 14 rather than on the glass button 12*a*. Shield 14 may be formed of aluminum or nickel, such as nickel 205(S). The wire should be degassified and free from any surface contaminants, such as carbon, oil, or other foreign materials. Copper or zirconium may be satisfactorily substituted for the nickel or aluminum.

In a test to evaluate the effect of the shield 14, a number of "3-lite" lamps of the type described above (50/200/250 watt A23 lamps) were made with and without the shield 14. The test group burned "base up" with the shield 14 lasted 196 hours longer than standard lamps, a gain of 18%, and met the required lamp life of 1200 hours. In a second test operating the lamps "base up" in a simulated three-light fixture again showed improved performance of the lamp with the shield. The lamps with the shield lasted 442 hours longer or a gain of 59%.

Figure 3:
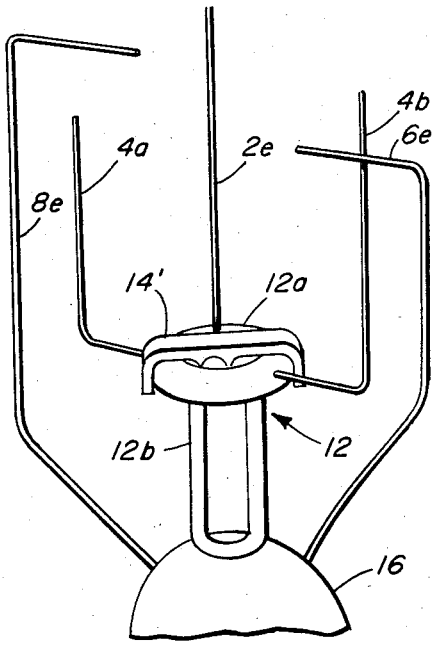
FIG. 3 is an elevation view on an enlarged scale of an alternate embodiment of the invention.
Figure 4:
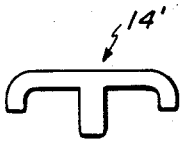
FIG. 4 is an elevation view of the shield 14' of FIG. 3.

FIGS. 3 and 4 show an alternate form embodiment of the invention in which like parts carry like numeral references. The main distinction between the embodiment of FIGS. 3 and 4 and that of FIGS. 1 and 2 is in the form and location of the shield. The shield in FIGS. 3 and 4 may be seen to comprise a generally T-shaped member 14' forming a metal tab of aluminum or nickel material. The cross members of the "T" are bent over the periphery of the doughnut-shape portion of arbor 12. The post portion of the "T" of member 14' is inserted in the longitudinal hole in the cylinder portion of arbor 12, so as to secure the shield 14' over the arbor 12. In other respects, the shield performs as previously described.

While preferred embodiments and modifications have been shown and described above, various other embodiments and modifications will become apparent to persons skilled in the art and will fall within the scope of the invention, as defined in the following claims. For example, the shield 14 or 14' may be formed of ceramic or other refractory material which can withstand the high temperature associated with lamp operating conditions or may be in the form of a mesh or wire screen.

We claim:

1. An electric lamp for operation in either a "base down" or "base up" orientation, comprising:

(a) a light transparent glass envelope affixed to a lamp base, (b) a stem means extending from said lamp base within said envelope, (c) a pair of resistive filaments within said envelope, (d) lead-in wires extending from the lamp base and said stem means and connected to said filaments, (e) an arbor supported by said stem means within said envelope, (f) filament support wires supported by said arbor and connected between said arbor and said filaments, (g) shield means disposed intermediate said filaments and said arbor to shield said arbor from filament evaporation products produced when said lamp is operated and which would otherwise deposit on said arbor when said lamp is operated in the "base up" orientation.

2. The lamp of claim 1 in which the arbor is formed of tubular glass with a doughnut-like pedestal at one end to which said support wires are connected.

3. The lamp of claim 1 in which the shield means is a V-shaped structure suspended over said pedestal.

4. The lamp of claim 3 in which the intersection of the two legs of the V-shaped structure is affixed to a lead-in wire.

5. The lamp of claim 4 in which the shield means is formed of a metal.

6. The lamp of claim 1 in which the shield means is formed of a ceramic.

7. The lamp of claim 1 in which the shield means is formed of a refractory material.

8. The lamp of claim 1 in which the shield means is formed of a mesh or wire screen.

9. An electric lamp, comprising:

(a) a light transparent glass envelope affixed to a lamp base, (b) stem means extending within said envelope from said lamp base, (c) a resistive filament within said envelope, (d) a lead-in wire extending through said stem means and connected to said filament, (e) an arbor within said envelope supported by said stem means, (f) a filament support wire supported by said arbor and connected between said arbor and said filament, (g) a shield means disposed intermediate said filament and said arbor to shield said arbor from filament evaporation products produced when said lamp is operated and which would otherwise deposit on said arbor.

10. The lamp of claim 9 in which the arbor is formed of tubular glass with a doughnut-like pedestal at one end to which said support wire is connected.

11. The lamp of claim 10 in which the shield means is suspended over said pedestal.

12. The lamp of claim 11 in which the shield means is a V-shaped structure and the intersection of the two legs of the V-shaped structure is affixed to the lead-in wire.

13. An electric lamp for operation in either a "base down" or "base up" orientation, comprising:

(a) a light transparent glass envelope affixed to a lamp base, (b) a pair of resistive filaments within said envelope, (c) lead-in wires connected to said filaments, (d) a tubular glass arbor with a doughnut-like pedestal within said envelope and affixed to a lamp stem which is affixed to said base, (e) filament support wires connected between the pedestal of said arbor and said filaments, (f) shield means disposed intermediate said filaments and said arbor to shield said arbor from filament evaporation products produced when said lamp is operated and which would otherwise deposit on said arbor when said lamp is operated in the "base up" orientation.

14. The lamp of claim 13 in which the shield means is a V-shaped structure suspended over said pedestal.

15. The lamp of claim 14 in which the intersection of the two legs of the V-shaped structure is affixed to a lead-in wire.

16. The lamp of claim 15 in which the shield means is formed of a metal.

17. An electric lamp, comprising:

(a) a light transparent glass envelope affixed to a lamp base, (b) a resistive filament within said envelope, (c) a lead-in wire connected to said filament, (d) an arbor formed of tubular glass with a doughnut-like pedestal at one end within said envelope, (e) a filament support wire connected between the pedestal of said arbor and said filament, (f) a shield means disposed intermediate said filament and said arbor to shield said arbor from filament evaporation products produced when said lamp is operated and which would otherwise deposit on said arbor.

18. The lamp of claim 17 in which the arbor is affixed at one end to a lamp stem which is affixed to said base.

* * * * *